US008877039B2

(12) United States Patent
Van Wees et al.

(10) Patent No.: US 8,877,039 B2
(45) Date of Patent: Nov. 4, 2014

(54) HYDROCARBON CONVERSION PROCESS

(75) Inventors: Mark Van Wees, Des Plaines, IL (US); Robert Haizmann, Rolling Meadows, IL (US)

(73) Assignee: UOP LLC, Des Plaines, IL (US)

( * ) Notice: Subject to any disclaimer, the term of this patent is extended or adjusted under 35 U.S.C. 154(b) by 252 days.

(21) Appl. No.: 13/432,792

(22) Filed: Mar. 28, 2012

(65) Prior Publication Data

US 2013/0256190 A1 Oct. 3, 2013

(51) Int. Cl.

| | |
|---|---|
| ***C10G 65/18*** | (2006.01) |
| ***C10G 65/14*** | (2006.01) |
| ***C10G 55/00*** | (2006.01) |
| ***C10G 47/26*** | (2006.01) |
| ***C10G 47/00*** | (2006.01) |
| ***C10G 45/00*** | (2006.01) |

(52) U.S. Cl.

USPC ..... 208/78; 208/107; 208/108; 208/209

(58) Field of Classification Search

CPC ..... C10G 45/00; C10G 45/02; C10G 45/58; C10G 47/00; C10G 47/22; C10G 47/24; C10G 47/26; C10G 49/00; C10G 49/10; C10G 49/12; C10G 51/00; C10G 65/00; C10G 65/14; C10G 2300/40; C10G 2300/4081; C10G 2300/42

USPC ..... 208/46, 59, 78, 79, 106, 107, 108, 177, 208/209

See application file for complete search history.

(56) References Cited

U.S. PATENT DOCUMENTS

| | | | | |
|---|---|---|---|---|
| 3,607,726 | A * | 9/1971 | Hallman | 208/108 |
| 5,474,977 | A | 12/1995 | Gatsis | |
| 5,755,955 | A | 5/1998 | Benham et al. | |
| 7,223,898 | B2 | 5/2007 | Rice | |
| 7,578,928 | B2 | 8/2009 | Lott et al. | |
| 7,727,490 | B2 | 6/2010 | Zhou | |
| 2009/0050526 | A1 | 2/2009 | Chen et al. | |
| 2009/0127161 | A1 | 5/2009 | Haizmann et al. | |
| 2009/0129998 | A1 | 5/2009 | Haizmann et al. | |
| 2010/0122931 | A1 | 5/2010 | Zimmerman et al. | |
| 2010/0122932 | A1 | 5/2010 | Haizmann et al. | |
| 2010/0243518 | A1 | 9/2010 | Zimmerman et al. | |
| 2010/0248946 | A1 | 9/2010 | Bauer et al. | |
| 2011/0303580 | A1 | 12/2011 | Haizmann | |
| 2011/0306490 | A1 | 12/2011 | Bhattacharyya et al. | |

OTHER PUBLICATIONS

Ahmad, M, et al., Modelling and optimisation for design of hydrogen networks for multi-period operation, 2010, Journal of Cleaner Production, vol. 18, pp. 889-899.*

U.S. Appl. No. 13/076,670, filed Mar. 31, 2011 by Wieber entitled, "Process for Hydroprocessing Two Streams", 26 pages.

(Continued)

*Primary Examiner* — Walter D Griffin
*Assistant Examiner* — Derek Mueller
(74) *Attorney, Agent, or Firm* — James C. Paschall

(57) ABSTRACT

One exemplary embodiment can be a process for hydrocarbon conversion. The process can include providing a feed to a slurry hydrocracking zone, obtaining a hydrocarbon stream including one or more C16-C45 hydrocarbons from the at least one separator, providing another feed to a hydrocracking zone, and providing hydrogen from a three-stage compressor to the slurry hydrocracking zone and the hydrocracking zone. Moreover, the slurry hydrocracking zone may include a slurry hydrocracking reactor and at least one separator.

20 Claims, 1 Drawing Sheet

(56) References Cited

OTHER PUBLICATIONS

Gillis et al., "Upgrading Residues for High Levels of Distillate Production", Petroleum Technology Quarterly, Fourth Quarter 2009, vol. 14, No. 5, pp. 59-69.
Gillis et al., "Residue Conversion Solutions to Meet North American Emissions Control Area and MARPOL Annex VI Marine Fuel Regulations", NPRA Annual Meeting Technical Papers, Mar. 21-23, 2010, vol. 2, pp. 776-798.
Haizmann et al., "Upgrading Residues to Maximize Diesel", 8th World Congress of Chemical Engineering Conference Schedule, Aug. 2009, p. 1.
Skripek et al., "The U-CAN Residcracking Process", Hydrocarbon Technology International, 1994, No. 1994, pp. 2930, 32-33.

* cited by examiner

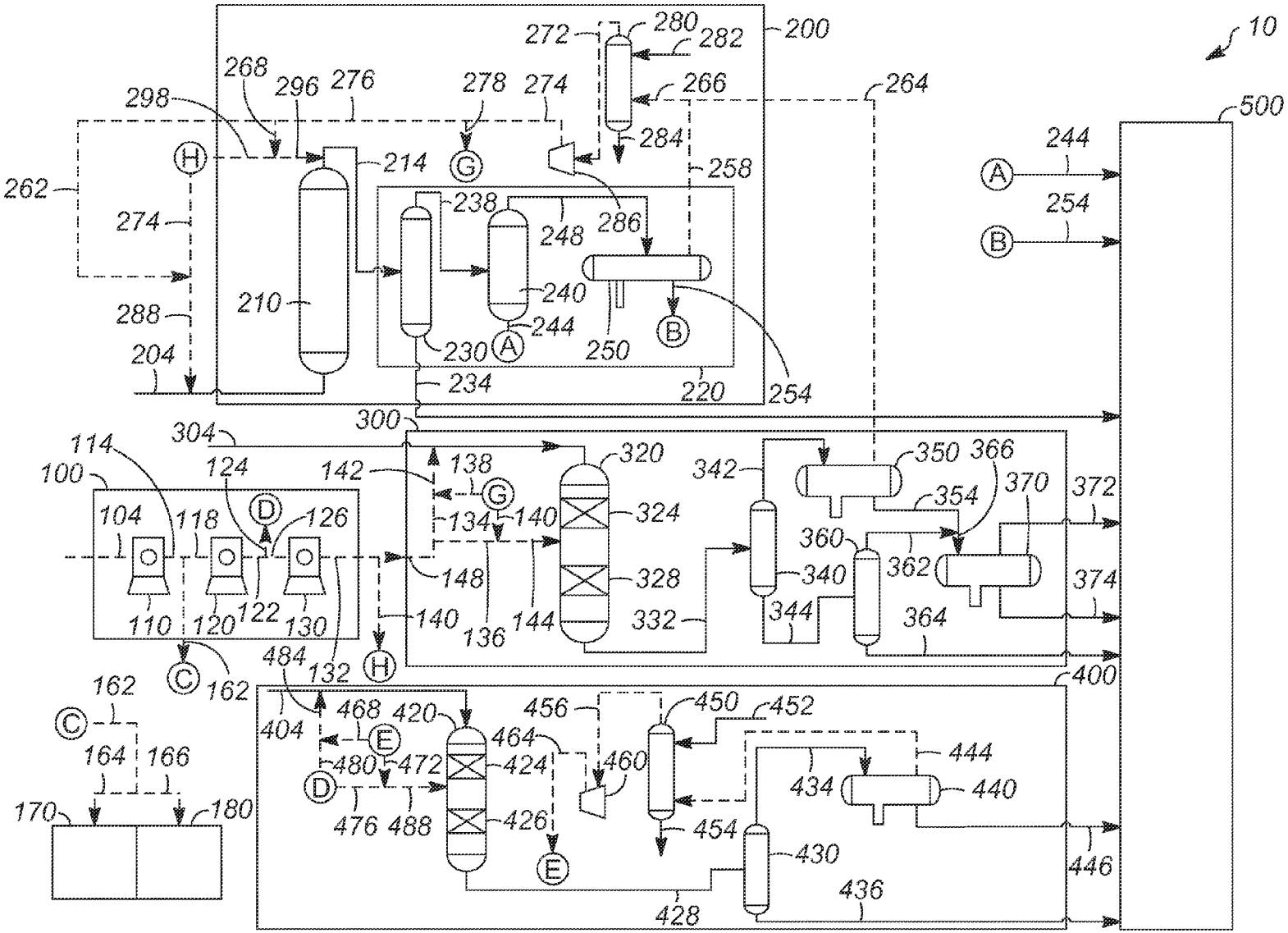
10
500
244
254
A
B
372
374
400
446
264
200
258
254
220
280
282
266
284
272
274
278
G
286
248
240
244
250
238
230
234
214
276
296
268
210
298
H
274
288
204
262
300
304
124
142
138
134
140
148
136
144
320
324
328
332
342
344
340
360
350
354
366
370
362
364
126
122
130
118
120
110
104
114
100
D
C
162
164
166
180
170
452
450
454
428
430
434
436
440
444
460
456
464
424
426
420
472
488
476
468
480
484
404
E

HYDROCARBON CONVERSION PROCESS

FIELD OF THE INVENTION

This invention generally relates to a process for hydrocarbon conversion and a process for hydrogen distribution in an apparatus.

DESCRIPTION OF THE RELATED ART

Many configurations have been proposed to reduce capital costs by integrating processing units. Often, hydroprocessing units may utilize similar feeds, catalysts, process conditions, and various utilities. As such, hydroprocessing units can share make-up and recycle gas systems, such as those systems that provide hydrogen. The hydrogen can be compressed to the pressure required by the individual units. Such compression is usually undertaken with a compressor. Thus, it can be desirable to minimize the cost and number of compressors, as compressors can be an expensive component for a hydroprocessing unit. As a result, any integration and sharing of equipment can reduce the costs of manufacturing and maintaining the hydroprocessing facility. Therefore, it can be desirable to manufacture hydroprocessing facilities in an economic and efficient manor to minimize capital costs and increase opportunities for sharing equipment infrastructure.

SUMMARY OF THE INVENTION

One exemplary embodiment can be a process for hydrocarbon conversion. The process can include providing a feed to a slurry hydrocracking zone, obtaining a hydrocarbon stream including one or more C16-C45 hydrocarbons from the at least one separator, providing another feed to a hydrocracking zone, and providing hydrogen from a three-stage compressor to the slurry hydrocracking zone and the hydrocracking zone. Moreover, the slurry hydrocracking zone may include a slurry hydrocracking reactor and at least one separator.

Another exemplary embodiment can be a process for hydrogen distribution for an apparatus. The process may include providing a three-stage compressor having a first stage, a second stage, and a third stage; providing hydrogen from the first stage to at least one of a naphtha hydrotreating zone and an isomerization zone; providing hydrogen from the second stage to a hydrotreating zone; and providing hydrogen from the third stage to at least one of a slurry hydrocracking zone and a hydrocracking zone.

A further exemplary embodiment may be a process for hydrogen distribution for an apparatus. The process can include providing a three-stage compressor including a first stage, a second stage, and a third stage; providing hydrogen from the first stage to at least one of a naphtha hydrotreating zone and an isomerization zone; providing hydrogen from the second stage to a hydrotreating zone; providing hydrogen from the third stage to a slurry hydrocracking zone; and providing hydrogen from the third stage to a hydrocracking zone. The hydrocracking zone may include a hydrocracking reactor, a hot separator, a cold separator, a hot flash drum, and a cold flash drum. Also, the hydrotreating zone can include a hydrotreating reactor, a hot separator, a cold separator, and a recycle gas compressor. Often, hydrogen is recycled from the cold separator to the hydrotreating reactor. Additionally, the slurry hydrocracking zone may include a slurry hydrocracking reactor, a hot separator, a warm separator, a cold separator, and a recycle gas compressor. Generally, hydrogen is recycled from the slurry hydrocracking zone cold separator to the slurry hydrocracking reactor.

The embodiments provided herein can allow the integration of make-up and recycle gas systems for hydrogen provided to a slurry hydrocracking zone, a hydrocracking zone, and a hydrotreating zone. As an example, integrating compression systems from two zones can allow a single spare to be utilized for the compressors operating with each respective zone, thereby eliminating capital costs. The embodiments disclosed herein can provide a three-stage compressor providing hydrogen to several zones and thus further reduce costs.

DEFINITIONS

As used herein, the term "stream" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. A stream can also include aromatic and non-aromatic hydrocarbons, or other gases absent hydrocarbons, such as hydrogen. Moreover, the hydrocarbon molecules may be abbreviated C1, C2, C3 . . . Cn where "n" represents the number of carbon atoms in the one or more hydrocarbon molecules. Furthermore, a superscript "+" or "−" may be used with an abbreviated one or more hydrocarbons notation, e.g., $C3^+$ or $C3^-$, which is inclusive of the abbreviated one or more hydrocarbons. As an example, the abbreviation "$C3^+$" means one or more hydrocarbon molecules of three carbon atoms and/or more.

As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, dryer, or vessel, can further include one or more zones or sub-zones.

As used herein, the term "megapascal" may be abbreviated "MPa".

As used herein, the term "liquid hourly space velocity" may be abbreviated "LHSV".

As used herein, the term "overhead stream" can mean a stream withdrawn at or near a top of a vessel, typically a distillation column or flash drum.

As used herein, the term "bottom stream" can mean a stream withdrawn at or near a bottom of a vessel, typically a distillation column or flash drum.

As depicted, process flow lines in the FIGURE can be referred to interchangeably as, e.g., lines, pipes, feeds, products, parts, portions, or streams.

BRIEF DESCRIPTION OF THE DRAWING

The FIGURE is a schematic depiction of an exemplary apparatus.

DETAILED DESCRIPTION

Referring to the FIGURE, an exemplary apparatus 10 can include a three-stage compressor 100, a slurry hydrocracking zone 200, a hydrocracking zone 300, and a hydrotreating zone 400, and a separation zone 500. Optionally, the apparatus 10 may also include a naphtha hydrotreatment zone 170 and an isomerization zone 180. An exemplary naphtha hydrotreatment zone is disclosed in, e.g., U.S. Pat. No. 7,727,490 and an exemplary isomerization zone is disclosed in, e.g., U.S. Pat.

No. 7,223,898. Often, the apparatus 10 can be any suitable refinery or chemical manufacturing facility. Generally, the apparatus 10 can include a make-up hydrogen system that includes the three-stage compressor 100 and a recycle hydrogen system that may permit recycling of hydrogen in and among the zones 200, 300, and 400. Generally, the recycle hydrogen system contains hydrogen that has higher amounts of impurities, such as one or more C1-C3 hydrocarbons, as compared to the make-up hydrogen system. These hydrogen systems will be discussed in further detail hereinafter and are indicated in the FIGURE by dashed lines.

The three-stage compressor 100 can include a first stage compressor 110, a second stage compressor 120, and a third stage compressor 130 and provide make-up hydrogen to the zones 170, 180, 200, 300, and 400. Hence, the three-stage compressor 100 can include several stages integrated together and can provide hydrogen to the various hydroprocessing zones at the requisite pressure. Particularly, the first stage compressor 110 can receive a hydrogen stream 104 and provide an outlet or discharge stream 114; the second stage compressor 120 can receive a portion 118 of the outlet or discharge stream 114 and provide an outlet or discharge stream 122 at a higher pressure; and the third stage compressor 130 can receive a portion 126 of the second stage outlet or discharge stream 122 and provide an outlet or discharge stream 132 at an even higher pressure.

The suction pressure for the first stage compressor 110 can be about 2.0-about 3.0 MPa, the suction pressure for the second stage compressor 120 can be about 4.0-about 6.0 MPa, and the suction pressure for the third stage compressor 130 can be about 8.0-about 12.0 MPa. The discharge pressure for the first stage compressor 110 may be about 4.0-about 6.0 MPa; for the second stage compressor 120 may be about 8.0-about 12.0 MPa, preferably about 8.0-about 10.0 MPa; and for the third stage compressor 130 may be about 16.0-about 24.0 MPa, preferably about 16.0-about 19.0 MPa. Generally, the first stage compressor 110 and the second stage compressor 120 may have respective coolers and knock-out pots prior to, respectively, the suction of the second stage compressor 120 and the third stage compressor 130.

Often, parallel compressors are installed. In a typical installation, a total of ten stages of compression can be eliminated from the slurry hydrocracking zone 200 and the hydrotreating zone 400 by increasing the size of the hydrocracking zone 300 compressors. Using the three-stage compressor 100 may reduce cost by at least 25% by integrating the compression systems for the various zones 200, 300, and 400. Additional savings may be obtained by utilizing larger compressors.

The slurry hydrocracking zone 200 can include a slurry hydrocracking reactor 210, at least one separator 220, a recycle gas scrubber 280, and a recycle gas compressor 286. Generally, the slurry hydrocracking reactor 210 can operate at any suitable conditions, such as a temperature of about 400-about 500° C. and a pressure of about 3-about 24 MPa. Exemplary slurry hydrocracking zones are disclosed in, e.g., U.S. Pat. No. 5,755,955; U.S. Pat. No. 5,474,977; US 2009/0127161; US 2010/0248946; US 2011/0306490; and US 2011/0303580. Often, slurry hydroprocessing is carried out using reactor conditions sufficient to crack at least a portion of a feed 204 to lower boiling products, such as one or more distillate hydrocarbons, naphtha, and/or C1-C4 products. The feed 204 can include hydrocarbons boiling from about 340-about 570° C., and may include one or more of a crude oil atmospheric distillation column residuum boiling above about 340° C., a crude oil vacuum distillation column residuum boiling above about 560° C., tars, a bitumen, coal oils, and shale oils. A catalyst may be combined with the feed 204 to obtain a solids content of about 0.01-about 10%, by weight, before being combined with hydrogen, as hereinafter described.

Typically, the slurry catalyst composition can include a catalytically effective amount of one or more compounds having iron. Particularly, the one or more compounds can include at least one of an iron oxide, an iron sulfate, and an iron carbonate. Other forms of iron can include at least one of an iron sulfide, a pyrrhotite, and a pyrite. What is more, the catalyst can contain materials other than an iron, such as at least one of molybdenum, nickel, and manganese, and/or a salt, an oxide, and/or a mineral thereof. Preferably, the one or more compounds includes an iron sulfate, and more preferably, at least one of an iron sulfate monohydrate and an iron sulfate heptahydrate.

Alternatively, one or more catalyst particles can include about 2-about 45%, by weight, iron oxide and about 20-about 90%, by weight, alumina. In one exemplary embodiment, iron-containing bauxite is a preferred material having these proportions. Bauxite can have about 10-about 40%, by weight, iron oxide, and about 54-about 84%, by weight, alumina and may have about 10-about 35%, by weight, iron oxide and about 55-about 80%, by weight, alumina Bauxite also may include silica and titania in amounts of usually no more than about 10%, by weight, and typically in amounts of no more than about 6%, by weight. Volatiles such as water and carbon dioxide may also be present, but the foregoing weight proportions exclude such volatiles. Typically, iron oxide is also present in bauxite in a hydrated form, but again the foregoing proportions exclude water in the hydrated composition.

In another exemplary embodiment, it may be desirable for the catalyst to be supported. Such a supported catalyst can be relatively resilient and maintain its particle size after being processed. As a consequence, such a catalyst can include a support of alumina, silica, titania, one or more aluminosilicates, magnesia, bauxite, coal and/or petroleum coke. Such a supported catalyst can include a catalytically active metal, such as at least one of iron, molybdenum, nickel, and vanadium, as well as sulfides of one or more of these metals. Generally, the catalyst can have about 0.01-about 30%, by weight, of the catalytic active metal based on the total weight of the catalyst.

The at least one separator 220 can include a hot separator 230, a warm separator 240, and a cold separator 250. Generally, an effluent 214 from the slurry hydrocracking reactor 210 can be provided to the at least one separator 220 with various hydrocarbon streams being obtained, such as a bottom stream 234 from the hot separator 230, a bottom stream 244 from the warm separator 240, and a bottom stream 254 from the cold separator 250. Often, the hot separator 230 can be about 200-about 480° C., and the warm separator 240 can be about 170-about 380° C. Generally, the cold separator 250 is no more than about 100° C., preferably no more than about 70° C. The streams 234, 244, and 254, can be provided to the separation zone 500. Moreover, a top stream 238 from the hot separator 230 can be provided to the warm separator 240, which in turn can provide a top stream 248 to the cold separator 250.

The hydrocracking zone 300 can include a hydrocracking reactor 320, a hot separator 340, a cold separator 350, a hot flash drum 360, and a cold flash drum 370. Generally, the hydrocracking zone 300 can receive another feed 304 to be received within the hydrocracking reactor 320. The another feed 304 can include a vacuum gas oil or other hydrocarbon fraction having at least about 50%, by weight, of its components boiling at a temperature above about 390° C.

Generally, the hydrocracking reactor 320 can operate at any suitable conditions, such as a temperature of about 290-about 470° C. and a pressure of about 3.5-about 21 MPa. Generally, the hydrocracking reactor 320 can include a first bed 324 and a second bed 328 containing any suitable catalyst. Afterwards, the hydrocracking reactor 320 can provide an effluent 332. Although only one hydrocracking reactor 320 is depicted in the hydrocracking zone 300, it should be understood that additional hydrocracking reactors may be utilized as well as other suitable reactors, such as a hydrotreating reactor.

Suitable hydrocracking catalysts may include amorphous silica-alumina bases or low-level zeolite bases combined with one or more Group VIII or Group VIB metal hydrogenating components. Alternatively, the catalyst may include any crystalline zeolite cracking base with a deposited Group VIII metal hydrogenating component, such as iron, cobalt, nickel, ruthenium, rhodium, palladium, osmium, iridium and platinum. Additional hydrogenating components may be selected from Group VIB such as molybdenum and tungsten for incorporation with the zeolite base.

Sometimes, the zeolite cracking bases are referred to as molecular sieves and are usually composed of silica, alumina and one or more exchangeable cations such as sodium, magnesium, calcium, and rare earth metals. The hydrocracking conditions may include a temperature of about 290-about 470° C., a pressure of about 3.5-about 20.7 MPa, a LHSV from about 1.0—less than about 2.5 $hr^{-1}$, and a hydrogen rate of about 420-about 2,530 $Nm^3/m^3$ oil.

Often, the effluent 332 is provided to the hot separator 340, which can provide a top stream 342 and a bottom stream 344. Typically, the top stream 342 is provided to the cold separator 350, which in turn provides a bottom stream 354 to the cold flash drum 370. Often, the hot separator 340 can be about 200-about 470° C. Generally, the cold separator 350 is no more than about 100° C., preferably no more than about 70° C. The bottom stream 344 from the hot separator 340 may be provided to the hot flash drum 360, which in turn can provide a top stream 362 and a bottom stream 364. The top stream 362 may be combined with the bottom stream 354 to form a combined stream 366 provided to the cold flash drum 370. Generally, the cold flash drum 370 provides a top stream 372 and a bottom stream 374. The streams 364, 372, and 374 exiting the hydrocracking zone 300 can be provided to the separation zone 500.

The hydrotreating zone 400 can include a hydrotreating reactor 420, a hot separator 430, a cold separator 440, a recycle gas scrubber 450, and a recycle gas compressor 460. Generally, the hydrotreating zone 400 can desulfurize, denitrify, or saturate a further feed 404. The further feed 404 can include one or more C8-C21 hydrocarbons and have hydrocarbons boiling from about 180-about 370° C. Typically, the further feed 404 can be a diesel cut.

The further feed 404 can be provided to the hydrotreating reactor 420, which can operate at any suitable conditions, such as a temperature of about 290-about 460° C. and a pressure of about 3.0-about 9.0 MPa. The hydrotreating reactor 420 can contain any suitable number of beds, such as a first bed 424 and a second bed 426.

Suitable hydrotreating catalysts include those which are comprised of at least one Group VIII metal, preferably iron, cobalt and/or nickel, and at least one Group VI metal, preferably molybdenum and/or tungsten, on a high surface area support material, preferably alumina. Other suitable hydrotreating catalysts may include zeolitic catalysts, as well as noble metal catalysts where the noble metal may be selected from palladium and/or platinum. More than one type of hydrotreating catalyst may be used in the same vessel. Often, the Group VIII metal is present in an amount ranging from about 2-about 20%, by weight, and the Group VI metal is present in an amount ranging of about 1-about 25%, by weight.

Preferred hydrotreating reaction conditions include a temperature from about 290-about 455° C., a pressure of about 3.0-about 9.0 MPa, an LHSV of about 0.5-about 4 $hr^{-1}$, and a hydrogen rate of about 160-about 1,020 $Nm^3/m^3$ oil, with a hydrotreating catalyst or a combination of hydrotreating catalysts. Exemplary hydrocracking and hydrotreating zones are disclosed in, e.g., U.S. application Ser. No. 13/076,670 filed 31 Mar. 2011.

A hydrotreating effluent 428 can be obtained from the hydrotreating reactor 420 and provided to the hot separator 430. The hot separator 430 can provide a top stream 434 and a bottom stream 436. The bottom stream 436 can be provided to the separation zone 500 while the top stream 434 can be provided to the cold separator 440. Often, the hot separator 430 can be about 200-about 470° C. Generally, the cold separator 440 is no more than about 100° C., preferably no more than about 70° C. The cold separator 440 can provide a bottom stream 446 to the separation zone 500 and a top stream 444, containing mostly hydrogen, to the recycle gas scrubber 450. The recycle gas scrubber 450 can receive a lean amine stream 452 to wash the hydrogen by removing sulfur compounds. A rich amine stream 454 can exit a bottom of the recycle gas scrubber 450 that may also provide a top stream 456 that contains mostly hydrogen. The top stream 456 can be provided to the recycle gas compressor 460, which may provide a recycle or discharge stream 464 that can be recycled within the hydrotreating zone 400.

The separation zone 500 can include any suitable number of separation vessels and/or distillation columns to provide various hydrocarbon products. Although a single separation zone 500 is depicted, it should be understood that the separation zone 500 can include at least one of a separator and a fractionation column, and often includes multiple vessels to produce the desired hydrocarbon products and may include sub-zones.

Referring to the make-up hydrogen system, the three-stage compressor 100 can provide several hydrogen streams. As an example, a portion of the discharge stream 114 may be separated at point "C" and be provided as a stream 162 that may in turn be split into streams 164 and 166 and be provided to the respective naphtha hydrotreatment zone 170 and isomerization zone 180. As such, the pressure of the discharge stream 114 is often suitable for zones requiring a lower pressure.

The discharge stream 122 from the second stage compressor 120 can be split into a stream 124 that can be routed at point "D" to the hydrotreating zone 400 and combined with recycled hydrogen from point "E". The make-up and recycled hydrogen can be provided to the further feed 404 as well as the hydrotreating reactor 420 between the beds 424 and 426.

The hydrogen from the discharge stream 132 can be provided to at least one of the slurry hydrocracking zone 200 and the hydrocracking zone 300, and split into a stream 140 and collected at a point "H" and then provided, directly or indirectly, to the slurry hydrocracking zone 200. Particularly, the hydrogen may be provided as a stream 274 and as a stream 298. A recycled hydrogen stream 276 may be split into a recycled hydrogen portion 262 and a recycled hydrogen portion 268. The recycled hydrogen portion 262 can combined with the stream 274 to form a combined hydrogen stream 288 provided to the feed 204. Also, the recycled hydrogen portion 268 can be combined with the stream 298 to form a combined stream 296 provided to the effluent 214, as hereinafter described. Another portion of the discharge stream 132 can be obtained as a stream 148 and be split into streams 134 and 136 to be provided to, respectively, the another feed 304 for the hydrocracking zone 300 and the hydrocracking reactor 320 along with recycled hydrogen from point "G", as hereinafter described.

In addition, hydrogen gas can be recycled within and optionally among the zones 200, 300, and 400. Particularly, a top stream 258 can be obtained from the cold separator 250 in the slurry hydrocracking zone 200. Furthermore, a top stream 264 containing hydrogen can be obtained from the cold separator 350 in the hydrocracking zone 300 and be combined with the stream 258 to form a stream 266 provided to the recycle gas scrubber 280. The gases can be cleaned by being contacted with the lean amine stream 282 and obtained as a top stream 272 from the recycle gas scrubber 280. The stream 272 can be sent to the recycle gas compressor 286 to provide a discharge stream 274 that can be split into the stream 276 and a stream 278 at point "G" sent to the hydrocracking zone 300. This recycled hydrogen can be combined with the make-up hydrogen discussed above, namely a recycled hydrogen stream 138 can be combined with the make-up hydrogen stream 134 to form a combined hydrogen stream 142 added to the another feed 304, and a recycled hydrogen stream 140 may be combined with the make-up hydrogen stream 136 to form a combined hydrogen stream 144 provided to the hydrocracking reactor 320 between the first and second beds 324 and 328.

In addition, the recycled hydrogen portion 268 split from the recycled hydrogen stream 276 can be combined with the stream 298 to form the combined hydrogen stream 296 before being added to the effluent 214 from the slurry hydrocracking reactor 210.

Moreover, the top stream 444 from the hydrotreating zone 400 can be provided to the recycle gas scrubber 450. After washing, the hydrogen stream 456 provided to the recycle gas compressor 460 may be discharged as the recycle or discharge stream 464 at point "E". The recycle gas can be combined with the make-up hydrogen, particularly, recycle streams 468 and 472 may be combined with, respectively, make-up streams 480 and 476 to form combined hydrogen streams 484 and 488. These combined hydrogen streams 484 and 488 may be provided, respectively, to the further feed 404 and the hydrotreating reactor 420 between the first and second beds 424 and 426.

The embodiments disclosed herein can provide a recycle gas scrubber 280 servicing both a slurry hydrocracking zone 200 and a hydrocracking zone 300 further reducing capital costs. Generally, the hydrocracking zone 300 operates more effectively with a higher purity hydrogen. Therefore, make-up hydrogen can be provided to the inlet of the hydrocracking zone 300 to allow more severe processing. In addition to sharing of the recycle gas scrubber, the zones 200 and 300 may also share the recycle gas compressor 286, further reducing capital costs. Integration can also reduce utilities, such as wash water and amine systems.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for hydrocarbon conversion, comprising:
A) providing a feed to a slurry hydrocracking zone, wherein the slurry hydrocracking zone comprises:
1) a slurry hydrocracking reactor; and
2) at least one separator;
B) obtaining a hydrocarbon stream comprising one or more C16-C45 hydrocarbons from the at least one separator;
C) providing another feed to a hydrocracking zone; and
D) providing hydrogen from a three-stage compressor to the slurry hydrocracking zone and the hydrocracking zone.

2. The process according to claim 1, wherein the hydrocracking zone comprises a hydrocracking reactor, a hot separator, and a cold separator; and providing hydrogen from the cold separator to a recycle gas compressor in the slurry hydrocracking zone.

3. The process according to claim 1, further comprising providing a further feed to a hydrotreating zone.

4. The process according to claim 3, wherein the hydrotreating zone desulfurizes, denitrifies, or saturates the further feed.

5. The process according to claim 4, further comprising providing hydrogen from a second stage of the three-stage compressor to the hydrotreating zone, wherein the hydrotreating zone comprises providing a hydrotreating reactor, a hot separator, and a cold separator.

6. The process according to claim 1, further comprising providing hydrogen from a second stage of the three-stage compressor to a hydrotreating zone, and providing hydrogen from a third stage of the three-stage compressor to the slurry hydrocracking zone and the hydrocracking zone.

7. The process according to claim 1, further comprising providing hydrogen from a first stage of the three-stage compressor to at least one of a naphtha hydrotreating zone and an isomerization zone.

8. The process according to claim 1, wherein the slurry hydrocracking reactor operates at a temperature of about 400-about 500° C. and a pressure of about 3-about 24 MPa.

9. The process according to claim 1, wherein the hydrocracking zone comprises a hydrocracking reactor operating at a temperature of about 290-about 470° C. and a pressure of about 3.5-about 21 MPa.

10. The process according to claim 4, wherein the hydrotreating zone comprises a hydrotreating reactor operating at a temperature of about 290-about 460° C. and a pressure of about 3.0-about 9.0 MPa.

11. The process according to claim 1, wherein the at least one separator comprises a hot separator, a warm separator, and a cold separator.

12. The process according to claim 2, further comprising recycling at least a portion of the hydrogen from the cold separator to the hydrocracking zone.

13. A process for hydrogen distribution for an apparatus, comprising:
A) providing a three-stage compressor comprising a first stage, a second stage, and a third stage;
B) providing hydrogen from the first stage to at least one of a naphtha hydrotreating zone and an isomerization zone;
C) providing hydrogen from the second stage to a hydrotreating zone; and D) providing hydrogen from the third stage to at least one of a slurry hydrocracking zone and a hydrocracking zone.

14. The process according to claim 13, wherein the slurry hydrocracking zone comprises a slurry hydrocracking reactor and at least one separator.

15. The process according to claim 13, wherein the hydrocracking zone comprises a hydrocracking reactor, a hot separator, a cold separator, a hot flash drum, and a cold flash drum, and passing hydrogen from the cold separator to the slurry hydrocracking zone.

16. The process according to claim 13, wherein the hydrotreating zone comprises a hydrotreating reactor, a hot separator, and a cold separator.

17. The process according to claim 13, wherein the slurry hydrocracking zone and the hydrotreating zone comprise respective recycle gas compressors for providing hydrogen to, respectively, a feed to the slurry hydrocracking zone and a further feed to the hydrotreating zone.

18. The process according to claim 13, wherein a first discharge of the first stage operates at a pressure of about 4.0-about 6.0 MPa, a second discharge of the second stage operates at a pressure of about 8.0-about 12.0 MPa, and a third discharge of the third stage operates at a pressure of about 16.0-about 24.0 MPa.

19. The process according to claim 13, further comprising sending one or more hydrocarbons to a separation zone comprising at least one of a separator or a fractionation column.

20. A process for hydrogen distribution for an apparatus, comprising:

A) providing a three-stage compressor comprising a first stage, a second stage, and a third stage;

B) providing hydrogen from the first stage to at least one of a naphtha hydrotreating zone and an isomerization zone;

C) providing hydrogen from the second stage to a hydrotreating zone, wherein the hydrotreating zone comprises:

1) a hydrotreating reactor;

2) a hot separator;

3) a cold separator; and 4) a recycle gas compressor; wherein hydrogen is recycled from the cold separator to the hydrotreating reactor;

D) providing hydrogen from the third stage to a slurry hydrocracking zone; wherein the slurry hydrocracking zone comprises:

1) a slurry hydrocracking reactor;

2) a hot separator;

3) a warm separator;

4) a cold separator; and 5) a recycle gas compressor, wherein hydrogen is recycled from the slurry hydrocracking zone cold separator to the slurry hydrocracking reactor; and E) providing hydrogen from the third stage to a hydrocracking zone, wherein the hydrocracking zone comprises a hydrocracking reactor, a hot separator, a cold separator, a hot flash drum, and a cold flash drum.

* * * * *